US005937260A

United States Patent [19]

Taninaka et al.

[11] Patent Number: 5,937,260

[45] Date of Patent: Aug. 10, 1999

[54] DUAL-SIDED IMAGE FORMING DEVICE WITH IMPROVED RECORDING MEDIUM CORRECTION PART

[75] Inventors: Kiyoshi Taninaka; Shigeo Nonoyama; Yoshiya Matsumoto; Tetsuya Takei; Nobuyuki Tanaka, all of Kawasaki, Japan

[73] Assignee: Fujitsu Limited, Kawasaki, Japan

[21] Appl. No.: 08/893,073

[22] Filed: Jul. 15, 1997

[30] Foreign Application Priority Data

Dec. 12, 1996 [JP] Japan ..... 8-332317

[51] Int. Cl.[6] ..... G03G 15/00

[52] U.S. Cl. ..... 399/401; 271/240; 399/395

[58] Field of Search ..... 399/361, 381, 399/388, 390, 395, 401, 303; 271/226, 234, 236, 240, 248, 249, 250, 253, 254

[56] References Cited

U.S. PATENT DOCUMENTS

| | | | |
|---|---|---|---|
| 4,908,673 | 3/1990 | Muramatsu . | |
| 4,949,134 | 8/1990 | Iwaki et al. | 271/240 X |
| 5,078,384 | 1/1992 | Moore | 399/395 X |
| 5,091,754 | 2/1992 | Abe et al. | 271/234 X |
| 5,172,138 | 12/1992 | Okazawa et al. | 271/240 X |
| 5,215,303 | 6/1993 | Yamada et al. | 271/240 |
| 5,219,159 | 6/1993 | Malachowski et al. | 271/236 X |
| 5,249,023 | 9/1993 | Miyashiro et al. | 399/303 |
| 5,278,624 | 1/1994 | Kamprath et al. | 399/395 |

FOREIGN PATENT DOCUMENTS

| | | |
|---|---|---|
| 64-8161 | 1/1989 | Japan . |
| 6-48616 | 2/1994 | Japan . |

*Primary Examiner*—Sandra Brase

*Attorney, Agent, or Firm*—Armstrong, Westerman, Hattori, McLeland & Naughton

[57] ABSTRACT

An image forming device includes an image forming part which forms an image on a recording medium; a stacker which stores the recording mediums one on another; a recording medium switchback portion which receives the recording medium on a first run, one side of which has been printed when passing the image forming part, and sends the recording medium for a second run; an inverted recording medium transfer path through which the recording medium is sent to the image forming part with an upper surface and a lower surface of the recording medium reversed; a recording medium transfer part which transfers the recording medium along the inverted recording medium transfer path; a recording medium position correcting part, located at the inverted recording medium transfer path, which corrects a position in a width direction of the recording medium, and a control means for controlling the recording medium position correcting part with a particular operation timing so that the recording medium position correcting part is operated while the printing means is transferred along the inverted recording medium transfer path by the recording medium transfer part.

8 Claims, 14 Drawing Sheets

RESIST ROLLER
64
T2
PAPER
TRANSFER
STOP

T1
INVERTING
SENSOR
54
t0
T3

RESIST
SENSOR
62
T10

STEPPING
MOTOR
75

FIRST RUN
PAPER TRANSFER
SECOND RUN
PAPER
POSITION
CORRECTION
PAPER
TRANSFER
PAPER TRANSFER
STOP

DUAL-SIDED IMAGE FORMING DEVICE WITH IMPROVED RECORDING MEDIUM CORRECTION PART

BACKGROUND OF THE INVENTION

1. Field of the Invention

The present invention generally relates to image forming devices, and particularly, to an image forming device such as a dual-sided printer and a duplicator which are capable of both-side printing.

2. Description of the Related Art

FIG. 1 is a schematic diagram showing a conventional dual-sided printer 10 which is capable of both-side printing. The dual-sided printer 10 is comprised of a photoreceptor drum 11, a face-down stacker 12 which is located above the photoreceptor drum 11, a recording medium switchback portion 13 which is located in a side direction of the photoreceptor drum 11, a paper ejection path 14, a paper guide 15, a paper position adjusting mechanism 16, which is located at the end of the paper guide 15, and a paper cartridge 17. The face-down stacker 12 is capable of storing printed papers with a latest printed surface facing downward, i.e., the stacker 12 is capable of storing the printed papers in order of page numbers without requiring a large memory. The recording medium switchback portion 13 functions as a transfer means which receives a paper, one surface (upper surface) of which is printed by passing the photoreceptor drum 11, and transfers the paper in the reversed direction in order to perform a printing of the other side of the paper. Also, the paper guide 15 is operated so as to guide a paper, which is fed from the recording medium switchback portion 13, to an inlet of the photoreceptor drum 11.

In the dual-sided printer 10, the both-side printing is carried out as follows. When a paper is fed from the paper cartridge 17 in the direction A shown in FIG. 1, it is passed underneath the photoreceptor drum 11 as indicated by the arrow B and its upper surface is printed. Then, the paper is transferred in the direction C and reaches the recording medium switchback portion 13. At the recording medium switchback portion 13, the direction of the paper transfer is reversed and it is fed in the direction indicated by the arrows D and E towards the paper position adjusting mechanism 16 (the movement of a paper from the paper cartridge 17 to the paper position adjusting mechanism 16 is hereinafter referred to as a first run of the paper). The position of the paper which may be shifted during the first run may be adjusted (by centering or skew correction) by the paper position adjusting mechanism 16. After this, the paper is transferred in the direction indicated by the arrow F and passed again underneath the photoreceptor drum 11 so that the other side of the paper is printed. The paper, both sides of which are printed, is then moved in the direction indicated by the arrow G and is stored on the face-down stacker 12 (the movement of a paper from the paper position adjusting mechanism 16 to the face-down stacker 12 is hereinafter referred to as a second run of the paper).

However, in the conventional dual-sided printer 10, the operation of the paper position adjusting mechanism 16 is started when a paper is transferred to the end of the paper guide 15 and the transfer of the paper is stopped.

Thus, since the operation of the paper position adjusting mechanism 16 is started after the transfer of the paper is stopped, the actual operation of the dual-sided printer 10 during the termination of the first run of a paper and the start of the second run of the paper may become as indicated in FIG. 2, i.e., paper transfer (first run)→paper transfer stop→paper position adjustment→paper transfer (second run). Thus, a time for adjusting the position of a paper is additionally required besides a time for transferring the paper, and hence the speed of the both-side printing is slowed down.

Also, the paper position adjusting mechanism 16 has a structure in which a pair of right and left guiding members are moved symmetrically towards the center so as to push a paper by one of the guiding members, which is provided with an elastic member, and receives the paper by the other guiding member. In this manner, the position of the paper may be corrected.

However, when the pair of right and left guiding members are separated from the paper, since both of them move symmetrically, the paper is still pushed by the elastic member due to its force as it returns to the original position, and hence there is a problem that the position of the paper may be shifted again.

SUMMARY OF THE INVENTION

It is a general object of this invention to provide an image forming device in which the abovementioned problems are solved.

A more specific object of the present invention is to provide an image forming device which is capable of performing the both-side printing with high speed.

Another object of the present invention is to provide a paper position adjusting mechanism used in the image forming device by which a position of a paper in a width direction may be smoothly corrected and there is no danger that the position of the paper once corrected is shifted again.

The objects described above are achieved by an image forming device comprising: an image forming part which forms an image on a recording medium; a recording medium switchback portion which receives the recording medium on a first run, one side of which has been printed when passing the image forming part, and sends the recording medium for a second run; an inverted recording medium transfer path through which the recording medium is sent to the image forming part with an upper surface and a lower surface of the recording medium reversed; a recording medium transfer part which transfers the recording medium along the inverted recording medium transfer path; a recording medium position correcting part, located at the inverted recording medium transfer path, which corrects a position in a width direction of the recording medium, and a control means for controlling the recording medium position correcting part with a particular operation timing so that the recording medium position correcting part is operated while the recording medium is transferred along the inverted recording medium transfer path by the recording medium transfer part.

According to the above image forming device, since the control means, by which the recording medium position correcting part is operated while the recording medium is transferred along the inverted recording medium transfer path, is provided, a correction in position of the recording medium may be carried out in the transfer state. Therefore, the actual operation of the image forming device according to the embodiment of the present invention during the termination of the first run of the recording medium and the beginning of the second run may become as follows: paper transfer (first run)→paper transfer stop→paper transfer (second run). Thus, a time necessary for adjusting the position of a paper, which is additionally required for a conventional image forming device, may be omitted, and hence the both-side printing using the image forming device according to the present invention may be performed in less time compared with a case in which a conventional image forming device is employed.

The objects described above are also achieved by the image forming device, wherein the recording medium transfer part is provided just in front of the recording medium position correcting part with respect to a recording medium transfer direction.

The objects described above are also achieved by the image forming device, wherein the recording medium transfer part is comprised of a single transfer roller which rotates in the recording medium transfer direction and a single pinch roller which is provided so as to push the transfer roller.

According to the above image forming device, since the recording medium transfer part is provided just in front of the recording medium position correcting part and the recording medium transfer part may be comprised of a single transfer roller and a single pinch roller, a recording medium may be pinched at one point. In other words, the recording medium may be moved in a transverse direction with respect to the transfer direction of the recording medium even when pinched by the recording medium transfer part, or may be rotated a little with the pinched point as a center. Thus, a correction operation in a width direction of the recording medium and a skew correction of the recording medium may be performed smoothly.

The objects described above are also achieved by the image forming device, wherein the pinch roller pushes the transfer roller with a relatively weak force so that a position of the recording medium may be corrected while the recording medium is pinched by the recording medium transfer part.

According to the above image forming device, since the pinch roller pushes the transfer roller with a relatively weak force so that a position of the recording medium may be corrected while the recording medium is pinched by the recording medium transfer part, a correction operation in a width direction of the recording medium and a skew correction of the recording medium may be carried out smoothly.

The objects described above are also achieved by the image forming device, wherein the transfer roller has a convex outer surface.

According to the above image forming device, since the transfer roller has a convex outer surface, the contacting length of the transfer roller and the recording medium in the axis direction is shortened compared with a case in which the surface of the transfer roller is, say, flat. Thus, the force applied to the recording medium is weakened, and hence a correction operation in a width direction of the recording medium and a skew correction of the recording medium may be performed smoothly.

The objects described above are also achieved by the image forming device further comprising at least one stacker which stores the recording medium one on another.

According to the above image forming device, since at least one stacker which stores the recording medium one on another, recording media which have been recorded may be stored in an efficient way.

The objects described above are also achieved by the image forming device, wherein the recording medium position correcting part is comprised of: a first guiding member which guides one side of the recording medium; a second guiding member which guides the other side of the recording medium; an elastic member, provided with one of the first guiding member and the second guiding member, which is deformed upon contact with the recording medium so that a position of the recording medium may be corrected between the first guiding member and the second guiding member; an operation mechanism by which the first guiding member and the second guiding member may be moved relative to each other in one of a direction to expand the distance between them and a direction to reduce the distance between them; and a backlash mechanism, provided for one of the first guiding member and the second guiding member which is not provided with the elastic member, which generates backlash in movement of the one of the first guiding member and the second guiding member which is not provided with the elastic member, wherein movement of one of the first guiding member and the second guiding member which is provided with the backlash mechanism is set to be delayed from movement of the other guiding member due to the presence of backlash when the first guiding member and the second guiding member are returned to their respective initial positions after the position of the recording medium is corrected.

The objects described above are also achieved by the image forming device, wherein the one of the first guiding member and the second guiding member which is not provided with the elastic member starts moving away from the recording medium, after the position of the recording medium is corrected, after the one of the first guiding member and the second guiding member which is provided with the elastic member is completely separated from the recording medium.

According to the above image forming device, since the movement of the one of the first guiding member and the second guiding member which is provided with the backlash mechanism is set to be delayed from the movement of the other guiding member due to the presence of backlash when the first guiding member and the second guiding member are returned to the respective initial position after the position of the recording medium is corrected, there is no danger that the position of the recording medium which is corrected by the first and the second guiding members is shifted again by the movement of the elastic member which is returning to the initial position (i.e., the other end of the recording medium is fixed by the first guiding member or the second guiding member while the elastic member is returning to the initial position, and the first guiding member or the second guiding member starts moving away from the recording medium after the elastic member is completely separated from the recording medium). Thus, it is possible to carry out the correction operation in a width direction of the recording medium with high accuracy.

Other objects and further features of the present invention will be apparent from the following detailed description when read in conjunction with the accompanied drawings.

DESCRIPTION OF THE PREFERRED EXAMPLES

In the following, a principle and examples of the present invention will be described in detail with reference to accompanied drawings.

Figure 1:
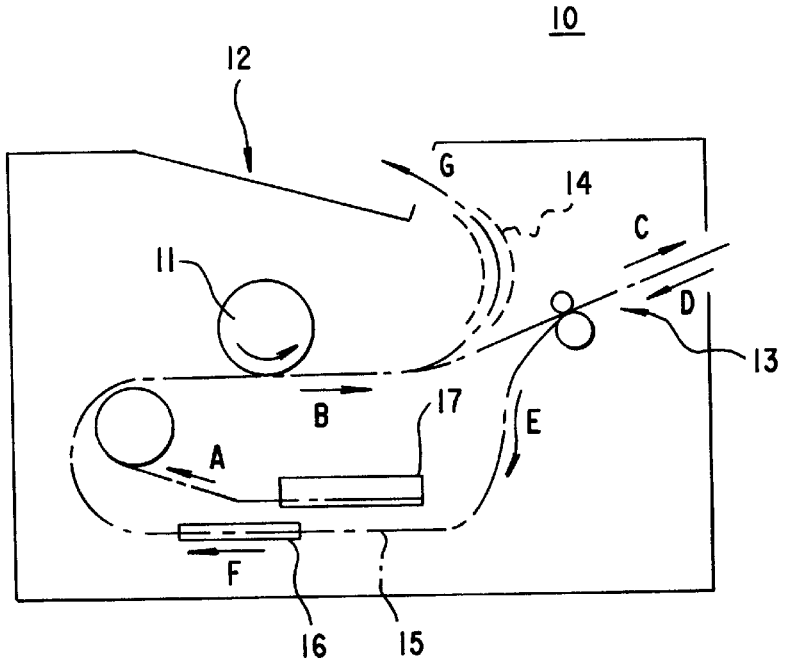
FIG.1 PRIOR ART
FIG. 1 is a schematic diagram showing a conventional dual-sided printer which is capable of both-side printing.
Figure 2:
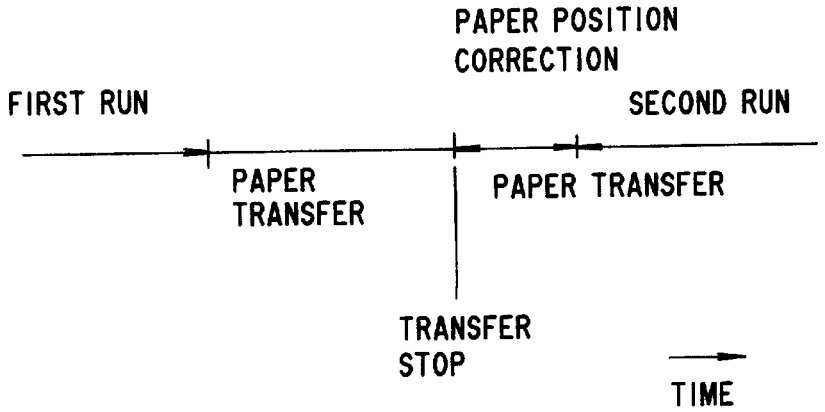
FIG.2 PRIOR ART
FIG. 2 is a diagram for explaining the operation of the conventional dual-sided printer from a first run of a paper to a second run of the paper.
Figure 3:
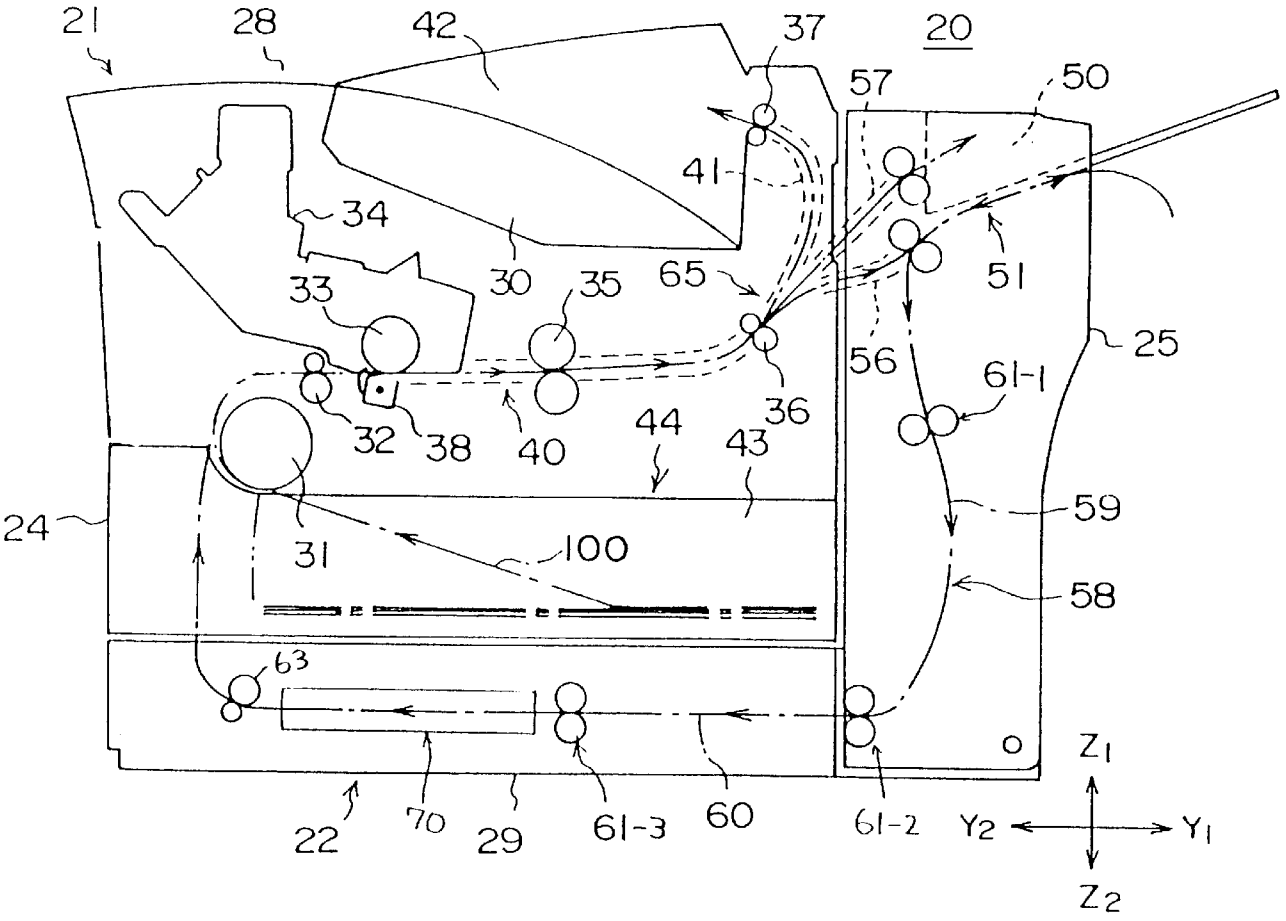
FIG. 3 is a schematic diagram of a dual-sided printer according to an embodiment of the present invention.
Figure 4:
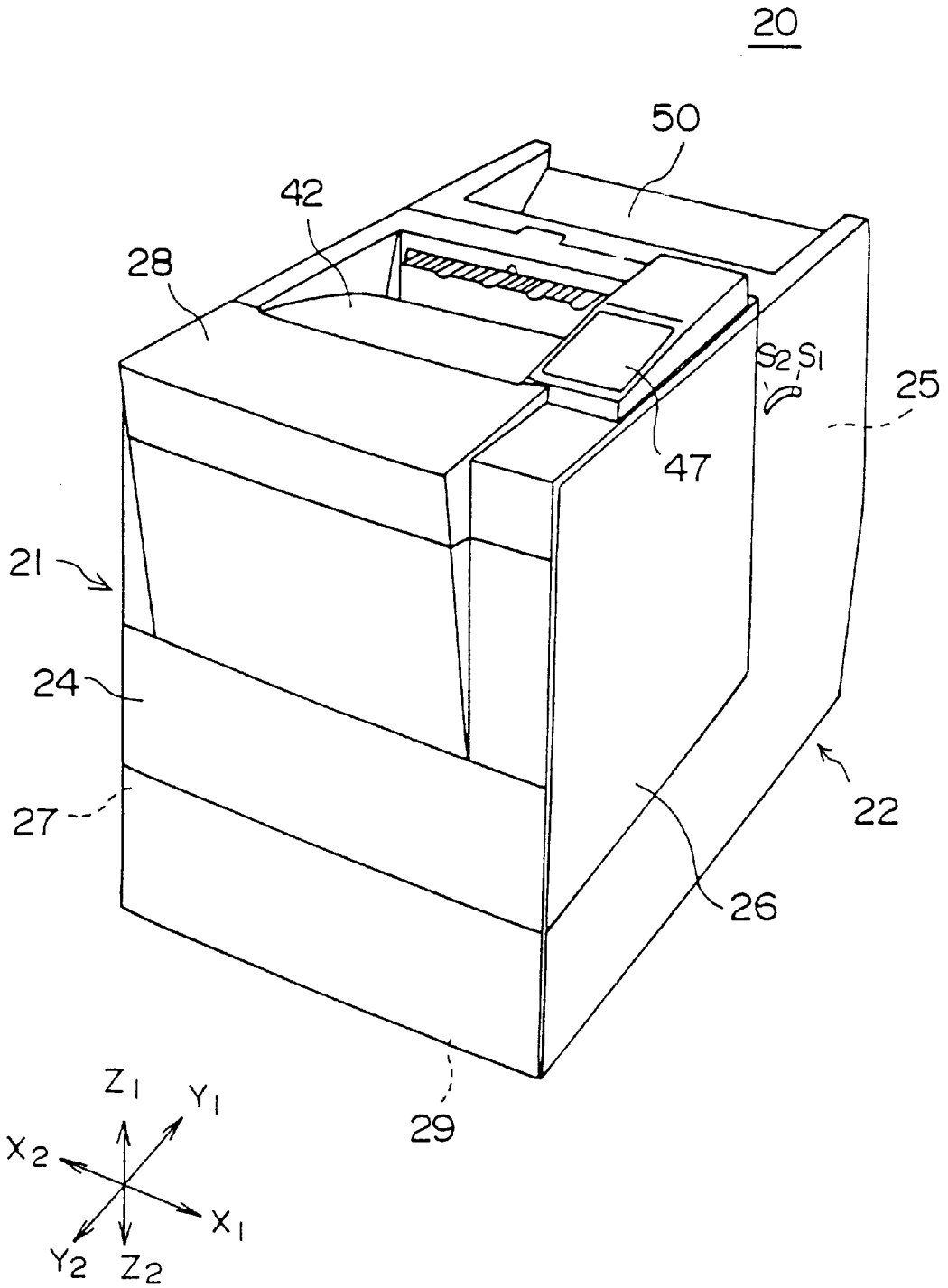
FIG. 4 is a diagram showing a perspective view of the dual-sided printer shown in FIG. 3.
Figure 5:
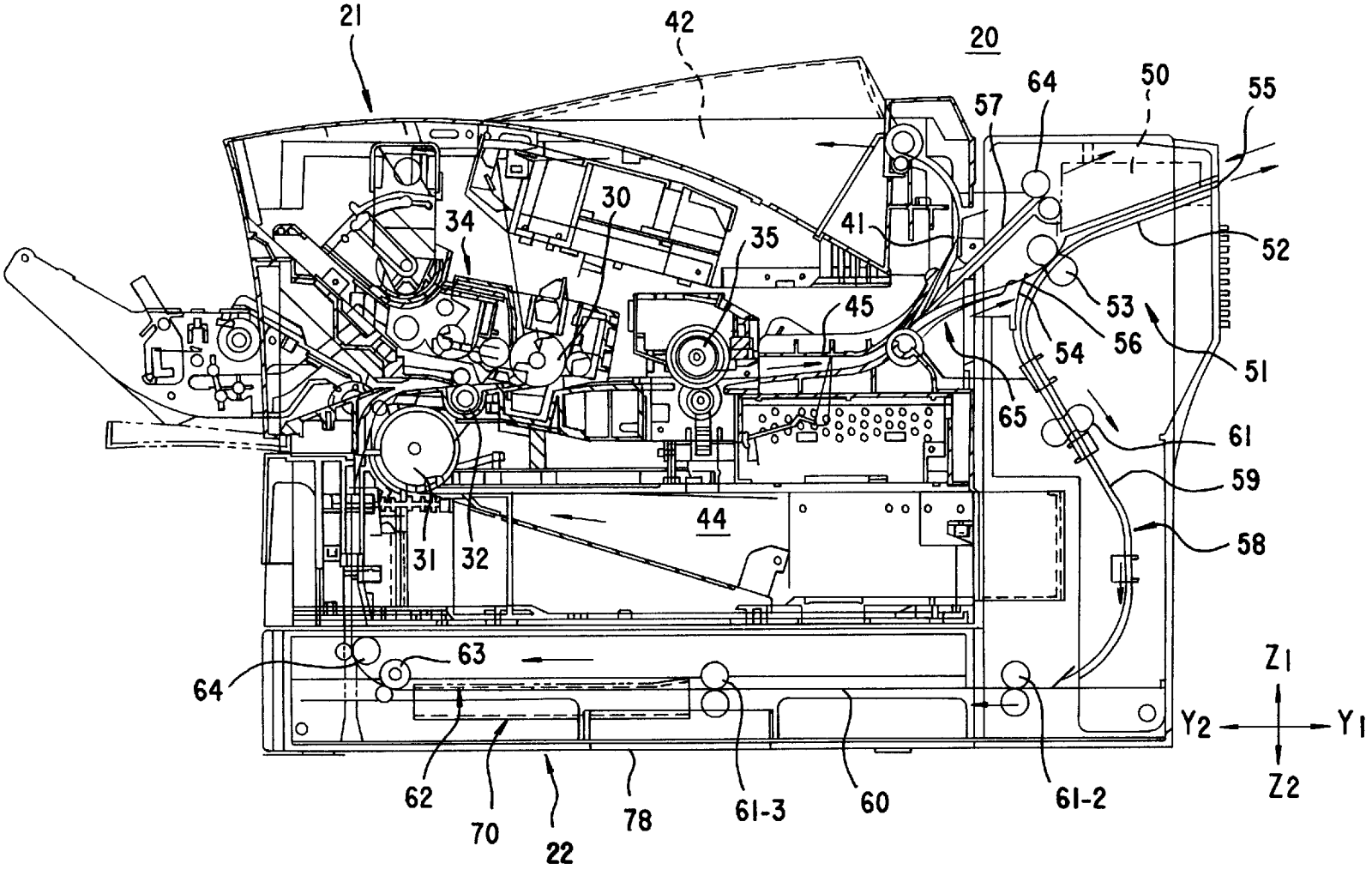
FIG. 5 is a structural diagram of the dual-sided printer shown in FIGS. 3 and 4.

FIGS. 3 through 5 are diagrams for explaining a dual-sided printer 20 according to an embodiment of the present invention. FIG. 3 shows a schematic diagram of the dual-sided printer 20 and FIG. 4 is a diagram showing a perspective view of the dual-sided printer 20. FIG. 5 is a diagram showing a structure of the dual-sided printer 20.

The dual-sided printer 20 according to an embodiment of the present invention is comprised of a printer body 21, which is capable of only one-side printing, and a both-side printing unit 22 having an L-shape, which may be combined with the printer body 21. The printer body 21 and the both-side printing unit 22 are connected mechanically and electronically.

In the figures, a front surface of the printer 20 is indicated by the numeral 24 and it is located in the direction indicated by Y2. Likewise, a back surface, a right-hand surface, and a left-hand surface of the printer 20 are indicated by the numeral 25, 26 and 27, respectively, and each of them is located in the direction indicated by Y1, X1 and X2, respectively. Also, an upper surface of the printer 20 is indicated by the numeral 28 and it is located in the direction indicated by Z1. Likewise, a lower surface of the printer 20 is indicated by the numeral 29 and it is located in the direction indicated by Z2.

First, the principle structure of the printer body 21 of the dual-sided printer 20 according to the embodiment of the present invention will be described in detail.

The printer body 21 may be comprised of an optical unit 30, a paper feeding roller 31, resist rollers 32, a photoreceptor drum 33, a processing unit 34, fixing members 35, paper sending rollers 36, paper ejection rollers 37 and so on. An image forming part according to the present invention may be formed by the optical unit 30, the photoreceptor drum 33, the processing unit 34 and the fixing members 35. As for a paper guiding mechanism of the printer body 21, it may be comprised of a recording path 40 between the resist rollers 32 and the paper sending rollers 36 and a paper ejection path 41 for a face-down stacker having substantially an arch shape, located between the paper sending rollers 36 and the paper ejection rollers 37.

Also, the printer body 21 has a face-down stacker 42 located above the recording path 40 (photoreceptor drum 33), and a paper feeding cassette 44, in which paper (or printable matter) 100 is contained, is provided in a space 43 located below the recording path 40 (photoreceptor drum 33). Moreover, an operation panel 47 shown in FIG. 4 is provided on the upper surface 28 of the printer body 21.

Further, an eject sensor 45 is provided substantially midway between the fixing members 35 and the paper sending rollers 36 so as to project in the recording path 40.

Since the face-down stacker 42 is located above the recording path 40 (photoreceptor drum 33) and the photoreceptor 33 and the processing unit 34 are provided on the recording path 40, a printing is performed on the upper surface of a paper 100 when the paper 100 is transferred in the Y1 direction in the printer body 21.

Next, the principle structure of the both-side printing unit 22 of the dual-sided printer 20 according to an embodiment of the present invention will be described in detail.

The both-side printing unit 22 includes a face-up stacker 50 provided on its upper surface. The face-up stacker 50 is capable of storing printed papers with the latest printing surface facing upward.

Also, the both-side printing unit 22 has a recording medium switchback portion 51 located immediately below the face-up stacker 50. The recording medium switchback portion 51 may be comprised of a paper receiving portion 52, reversible rollers 53 and an inverting sensor 54 as shown in FIG. 5.

The paper receiving portion 52 may be a flat space which may receive a paper 100 of first run, an upper surface of which is printed by passing the recording path 40 (the photoreceptor drum 33). An opening 55 is provided in the back surface 25 direction of the paper receiving portion 52.

The reversible rollers 53 are provided with an inlet of the paper receiving portion 52 in the Y1 direction and, firstly, rotate in a direction so that a paper 100 of first run from the paper sending rollers 36 is transferred in the direction of the paper receiving portion 52 (i.e., substantially the Y1 direction), and then rotates in a reversed direction so that the paper 100 in the paper receiving portion 52 may be transferred in substantially the Y2 direction.

The inverting sensor 54 is located in the Y2 direction from the inlet of the paper receiving portion 52 and projected in a paper path 56 for the recording medium switchback portion 51, which is provided between the paper sending rollers 36 and the paper receiving portion 52 (the recording medium switchback portion 51). The inverting sensor 54 may be rotated in a clockwise direction when pushed by a front end portion of a paper 100 transferring to the paper receiving portion 52 through the paper path 56, and is returned to an original position when the other end of the paper 100 has passed the inverting sensor 54. In this manner, the inverting sensor 54 may detect the passing of a paper and, at the same time, function as a guiding member which guides a paper to an inverted paper path 58 by blocking the paper path 56.

With regard to paper paths, the both-side printing unit 22 according to the present invention includes the above-mentioned paper path 56, a paper ejection path 57 for the face-up stacker and the inverted paper path 58.

The inverted paper path 58 may be comprised of an S-shape portion 59 extending from the reversible rollers 53 in the Z2 direction and a straight portion 60, connected to the S-shape portion 59, extending underneath the printer body 21 in the Y2 direction to resist rollers 63 located below the paper feeding roller 31. Thus, the inverted paper path 58 has a substantially L-shape (rotated L-shape at 90 degrees in a counterclockwise direction). The S-shape portion 59 has a function to remove curl of a paper 100.

A plurality of paper transfer rollers 61-1, 61-2, 61-3, . . . may be provided with the inverted paper path 58 and a resist sensor 62 and a paper position correcting device in a width direction (a width control device) 70 are provided in the vicinity of the end portion of the straight portion 60 of the inverted paper path 58. At the end of the straight portion 60, the resist rollers 63 and subsidiary transfer rollers 64 are provided.

The paper position correcting device in a width direction (the width control device) 70 is provided so as to correct the width direction of a paper 100 before entering a second run and carry out a printing of the other side of the paper 100 with high accuracy since it is possible that the shift in a width position of the paper occurs after traveling through the long inverted paper path 58.

Next, the paper position correcting device (the width control device) 70 according to the present invention will be described in detail.

Figures 6, 6A:
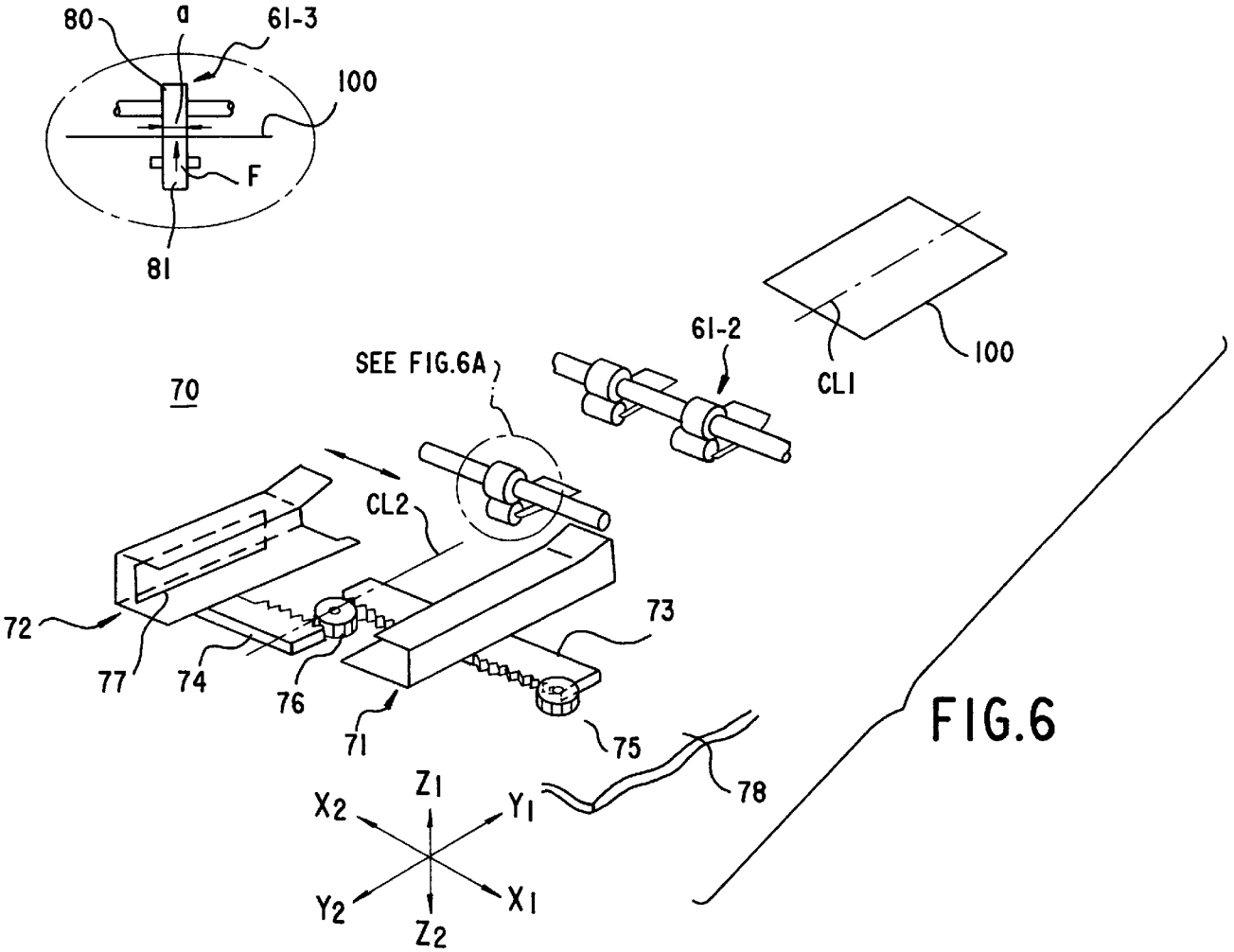
FIG. 6 is a diagram showing an exploded perspective view of a width control device according to an embodiment of the present invention.

FIG. 6 is a diagram showing an exploded perspective view of the width control device 70. As shown in FIG. 6, the width control device 70 may be comprised of a first guiding member 71, a second guiding member 72, a first rack 73 on which the first guiding member 71 is fixed, a second rack 74 on which the second guiding member 72 is fixed, a stepping motor 75 for operating the first rack 73, a connecting gear 76 engaged with the first rack 73 and the second rack 74 so as to be located between the first rack 73 and the second rack 74 as shown in the figure, and a leaf spring member 77 (also refer to FIG. 11) which is provided inside the second guiding member 72. Each of the first guiding member 71 and the second guiding member 72 has U-shape cross section and extends in the Y1–Y2 direction.

The width control device 70 may be provided on a bottom plate 78 of the both-side printing unit 22. The leaf spring member 77 of the width control device 70 forms a paper width error absorbing member, and the first rack 73, the second rack 74, the connecting gear 76 and the stepping motor 75 form a related operation mechanism.

The stepping motor 75 may be rotated a predetermined number of times in accordance with a type of a paper used. When the stepping motor 75 is rotated in a normal direction, the first rack 73 is moved in the X2 direction and, therefore, the second rack 74 is moved in the X1 direction via the connecting gear 76. Thus, the first guiding member 71 and the second guiding member 72 may be moved to a respective position corresponding to a width of a paper used. The first guiding member 71 and the second guiding member 72 contact respective sides of the paper and correct the position of it so that the center line CL1 in the width direction of the paper aligns with the center line CL2 of the inverted paper path 58 (the straight portion 60) (the above operation is called a centering) and the skew of the paper is also corrected.

Each of the paper transfer rollers 61-1 and 61-2 are formed of two pair of rollers similar to general paper transfer rollers. The paper transfer rollers 61-3, on the other hand, are comprised of a pair of rollers (a transfer roller 80 and a pinch roller 81, to be described later) so that a centering of a paper 100 may be performed in a transfer state.

Next, a control circuit which may be used in the dual-sided printer 20 according to the present invention will be explained with reference to FIG. 7.

Figure 7:
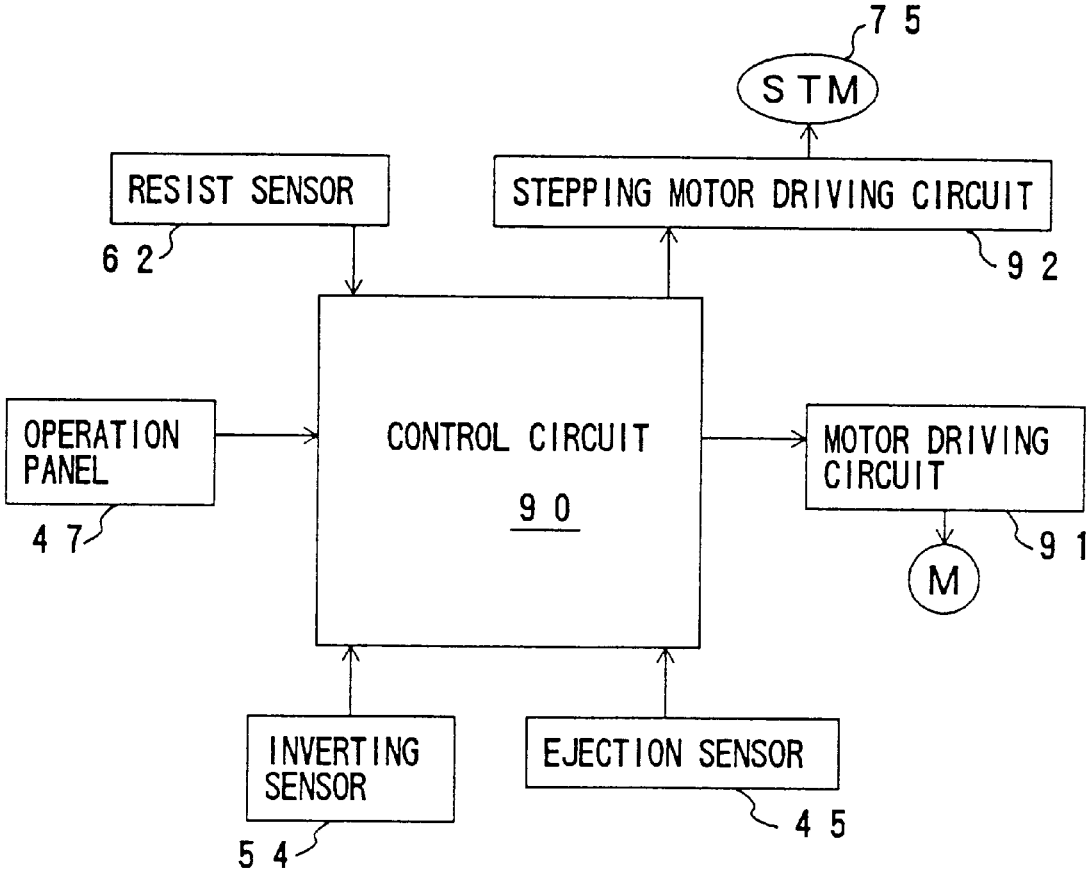
FIG. 7 is a diagram showing control block circuits may be used for the dual-sided printer according to the present invention.

FIG. 7 is a diagram showing control block circuits which may be used for the dual-sided printer 20. In FIG. 7, a control circuit 90 properly operates a motor driving circuit 91 and a stepping motor driving circuit 92 in accordance with an order from the operation panel 47 and information from the ejection sensor 45, the inverting sensor 54, the resist sensor 62 and so on. Thus, the stepping motor 75 may be appropriately operated. The control circuit 90 may be formed of microcomputers.

The above-mentioned dual-sided printer 20 may be operated as follows.

When it is ordered to perform a both-side printing of a paper 100 contained in the paper feeding cassette 44 through operation of the operating panel 47, the paper feeding roller 31 is rotated and the paper 100 is supplied from the paper feeding cassette 44. The position of the paper 100 is corrected when it has reached the resist rollers 32 and the position of the front end of the paper 100 is determined. Then, the paper 100 is transferred through the recording path 40 in the Y1 direction at a printing velocity and a printing operation (first run) is performed on its upper surface via the photoreceptor drum 33, on which electrostatic images are formed by the optical unit 30, and the fixing members 35.

The paper 100, the upper surface of which is printed by the above-mentioned operation, is exited from the recording path 40 by the paper sending rollers 36 and reaches a paper allotting mechanism 65 by which it is sent to the paper path 56. The paper 100 which has entered the paper path 56 is transferred by the reversible rollers 53 to the paper receiving portion 52. The inverting sensor 54 detects when the back end of the paper 100 reaches the position of the reversible rollers 53.

When the inverting sensor 54 detects the above-mentioned state, the rotation of the reversible rollers 53 is reversed and the paper 100 is transferred from the paper receiving portion 52 to the inverted paper path 58, guided by the inverting sensor 54. After this, the paper 100 is transferred through the inverted paper path 58, first, in the Z2 direction by the paper transfer rollers 61-1 and then in the Y2 direction by the paper transfer rollers 61-2 and 61-3 to reach the resist rollers 63 where the position of the paper 100 is corrected and its front position is determined. The width control device 70 may be operated during the transfer of the paper 100 in the Y2 direction before it reaches the resist rollers 63. This will be described in detail later.

Then, the paper 100 is transferred in the Z1 direction by the paper transfer rollers 61-2 and 61-3, the resist rollers 63 and the subsidiary transfer rollers 64, passing the paper feeding roller 31, and reaches the resist rollers 32 where its position is corrected once again. After the above operation, the paper 100 is moved through the recording path 40 in the Y1 direction at a printing velocity and a printing operation (second run) is performed on its upper surface (the other side) via the photoreceptor drum 33, on which electrostatic images are formed by the optical unit 30, and the fixing members 35.

The paper 100, both sides of which are printed by the above-mentioned operation, is exited from the recording path 40 by the paper sending rollers 36 and reaches the paper allotting mechanism 65 by which it is sent to the paper ejection path 41, instead of the paper path 56 this time. The paper 100, which has entered the paper ejection path 41, is transferred by the paper ejection rollers 37 and ejected on the face-down stacker 42. This is the end of the both-side printing operation of the paper 100.

Next, the operation timing of the paper position correcting device (the width control device) 70 according to an embodiment of the present invention will be explained with reference to FIGS. 8A through 8E.

Figures 8A, 8B, 8C, 8D, 8E:
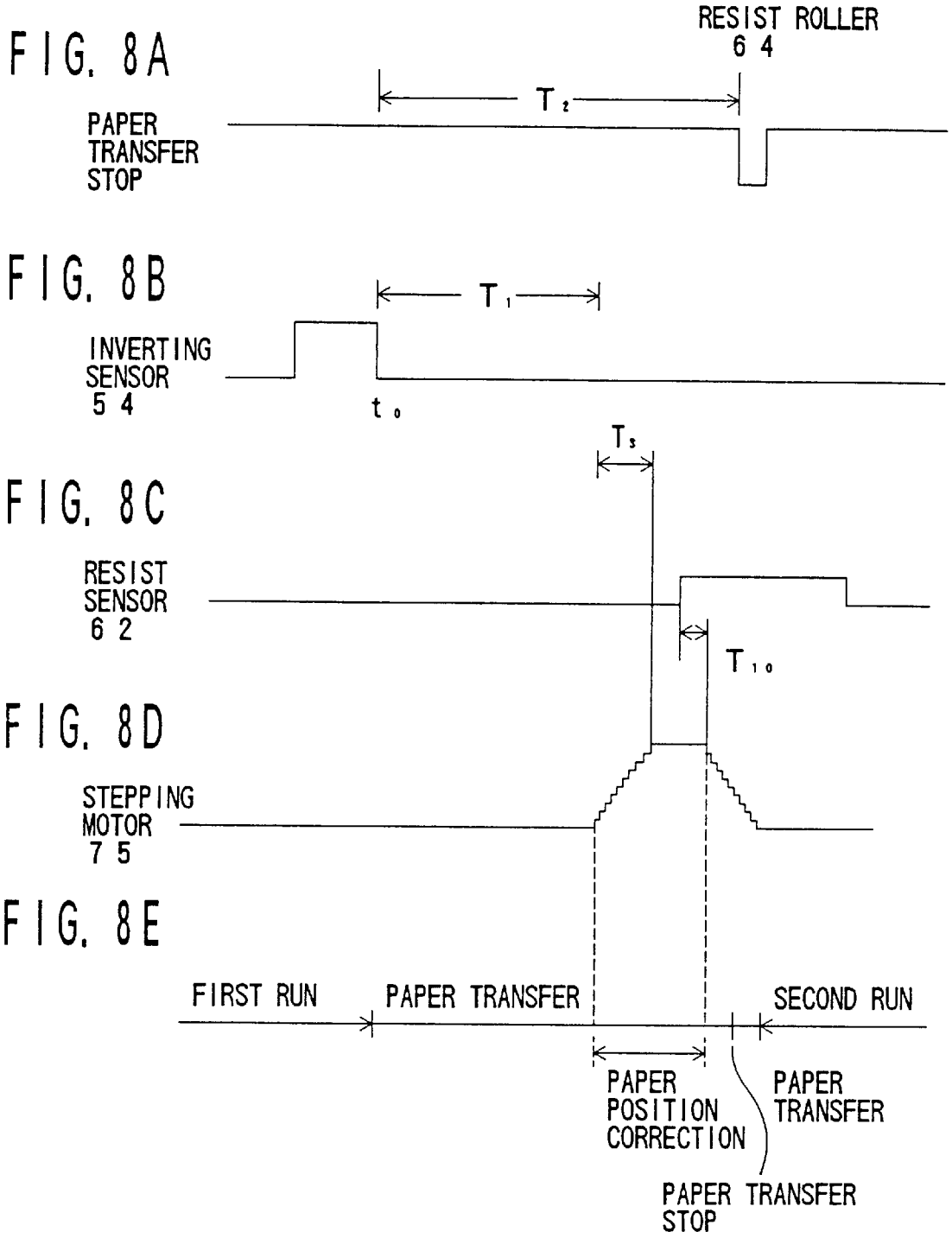
FIG. 8A is a diagram for explaining an operation timing of a paper position correcting device in a width direction with respect to a paper transfer.
FIG. 8B is a diagram for explaining an operation timing of the paper position correcting device with respect to an inverting sensor.
FIG. 8C is a diagram for explaining an operation timing of the paper position correcting device with respect to a resist sensor.
FIG. 8D is a diagram for explaining an operation timing of the paper position correcting device with respect to a stepping motor.
FIG. 8E is a diagram for explaining an operation timing of the paper position correcting device.

As shown in FIG. 8A, the paper 100 is transferred through the inverted paper path 58 until it reaches the resist rollers 63. A time, $T_2$, indicates the time between the detection of the back end of the paper 100 by the inverting sensor 54 and the contact of the paper 100 with the resist rollers 63 through the inverted paper path 58 by the reversible rollers 53, the paper transfer rollers 61-1, 61-2 and 61-3.

The stepping motor 75, as shown in FIG. 8D with reference to FIG. 8B, is actuated when a predetermined time, $T_1$, has elapsed after a time, $t_0$, which indicates the time at which the inverting sensor 54 detects the passing of the back end of the paper 100, and rotates, in a normal direction, a certain number of times in accordance with the size of the paper 100 and stops. After this, the stepping motor 75 is actuated again as shown in FIG. 8D with reference to FIG. 8C when a predetermined time, $T_{10}$, has elapsed after the resist sensor 62 detects the paper 100 and rotates, in a reversed direction, the same number of times as before and stops.

The above-mentioned predetermined time, $T_1$, is determined to be shorter than the time, $T_2$, by a time corresponding to $T_3$ which is a time required for the stepping motor 75 to rotate the predetermined number of times according to the embodiment of the present invention.

Figure 9:
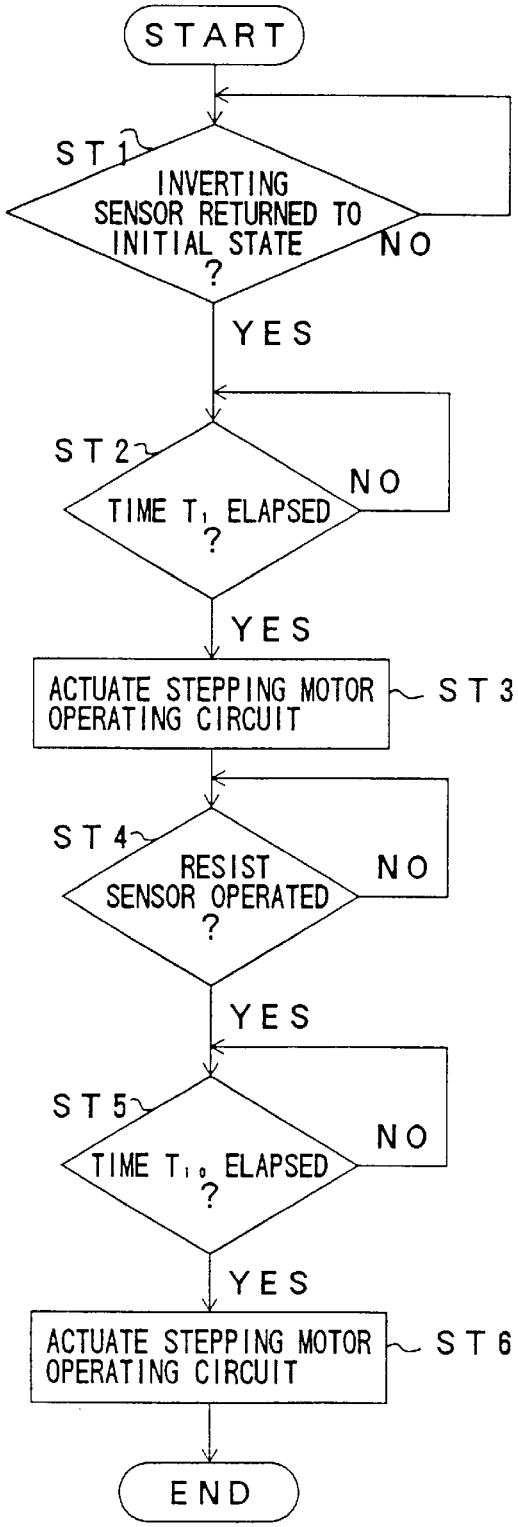
FIG. 9 is a flowchart showing an operation of a control circuit.

Next, the operation of the control circuit 90, which may be formed of microcomputers, will be explained with reference to FIG. 9.

Firstly, a return of the inverting sensor 54 to an initial state is determined in a step 1 (ST1) and the elapse of time $T_1$ after the return of the inverting sensor 54 is determined in a step 2 (ST2). Then, the stepping motor driving circuit 92 is operated so as to rotate the stepping motor 75 in the normal direction in a step 3 (ST3).

After that, whether the detection of a paper by the resist sensor 62 is carried out is determined in a step 4 (ST4) and the elapse of predetermined time $T_{10}$ after the detection of the paper by the resist sensor 62 is determined in a step 5 (ST5). Then, the stepping motor driving circuit 92 is operated so as to rotate the stepping motor 75 in the reversed direction in a step 6 (ST6) and the operation is terminated.

When the stepping motor 75 is rotated in the normal direction after the predetermined time, $T_1$, has elapsed from the time, to, the first rack 73 is moved in the X2 direction, and hence the second rack 74 is moved in the X1 direction via the connecting gear 76 so as to transfer the first guiding member 71 and the second guiding member 72 to the respective positions corresponding to the width of the paper 100 used. Each of the first guiding member 71 and the second guiding member 72 contacts the respective side of the paper 100 in a transfer state in the Y2 direction so that the center line, CL1, of the paper 100 in the width direction is aligned with the center line, CL2, of the inverted paper path 58 (the straight portion 60) (i.e., centering), and the skew of the paper 100 is also corrected.

Thus, since the correction of the position of the paper 100 is carried out in the transfer state, the actual operation of the dual-sided printer 20 according to the embodiment of the present invention during the termination of the first run of the paper 100 and the start of the second run of the paper 100 may become as shown in FIG. 8E, i.e., paper transfer a(first run)→paper transfer stop→paper transfer (second run). Thus, a time for adjusting the position of a paper, which is additionally required for a conventional printer, is no longer necessary, and hence the speed of the both-side printing is increased.

Also, the feeding of the paper 100 in the Z1 direction by the paper transfer rollers 61-2 and 61-3, the resist rollers 63 and the subsidiary transfer rollers 64 may be carried out smoothly in a state in which the first guiding member 71 and the second guiding member 72 are separated from the paper 100.

The structure of the paper transfer rollers 61-3 in the transfer state of the paper 100 will be explained as follows.

As shown in the circle in FIG. 6, the paper transfer rollers 61-3 may be comprised of a pair of rollers (a single transfer roller 80 made of urethane rubber and a single pinch roller 81 made of polyacetal). Also, the paper transfer rollers 61-3 are provided on the center line, CL2, of the inverted paper path 58 (the straight portion 60) so that a centering of the paper 100 in the transfer state may be performed. Moreover, the contacting length, a, of the transfer roller 80 and the pinch roller 81 in the X1–X2 direction (axis direction) in this embodiment is set to be about 10 mm and the pressing force, P, of the pinch roller 81 against the transfer roller 80 is set to be about 50 g. Although the pressing force of about 50 g is sufficient for transferring the paper 100, it is smaller than the force conventionally employed.

For this reason, when the paper 100 is pinched by the paper transfer rollers 61-3 at a position of the center line, CL1, in the width direction or in the vicinity of the center line, CL1, it is weakly held. Thus, when the first guiding member 71 and/or the second guiding member 72 pushes the respective side of the paper 100 in accordance with the movement of the first rack 73 and that of the second rack 74, respectively, the paper 100 may be moved in the X1 or X2 direction, even for the position pinched by the paper transfer rollers 61-3, during a short time and the position of the paper 100 in the width direction and the skew of the paper 100 may be corrected smoothly.

Note that the contacting length, a, of the transfer roller 80 and the pinch roller 81 in the X1–X2 direction may be about 50 mm and the pressing force, P, of the pinch roller 81 against the transfer roller 80 may be about 200 g. Also, if there is a deviation in the width of each of the paper 100, the flexibility of the above-mentioned leaf spring member 77 functions to solve the problem.

Figure 10A:
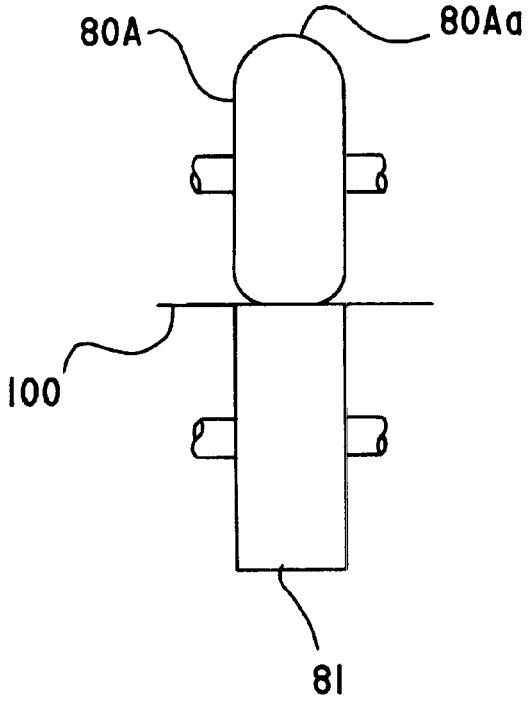
FIG. 10A is a diagram for showing a modified embodiment of the transfer roller according to the present invention.
Figure 10B:
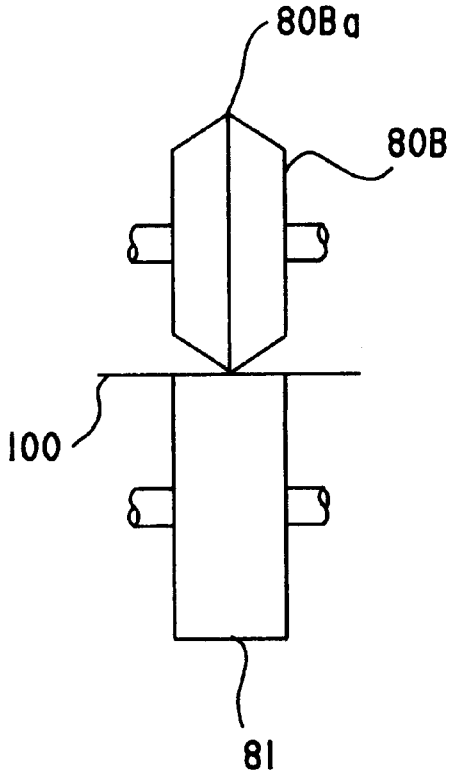
FIG. 10B is a diagram for showing another modified embodiment of the transfer roller according to the present invention.

FIGS. 10A and 10B are diagrams for showing modified embodiments of the transfer roller 80 which may be used for the paper transfer rollers 61-3. The transfer roller 80A shown in FIG. 10A has an outer surface 80A*a*, a cross section of which is semicircular. The transfer roller 80B shown in FIG. 10B, on the other hand, has an outer surface 80B*a*, a cross section of which is triangular. The transfer rollers 80A and 80B both have a convex surface and thus the contacting length, a, with the pinch roller 81 is short.

Figure 11:
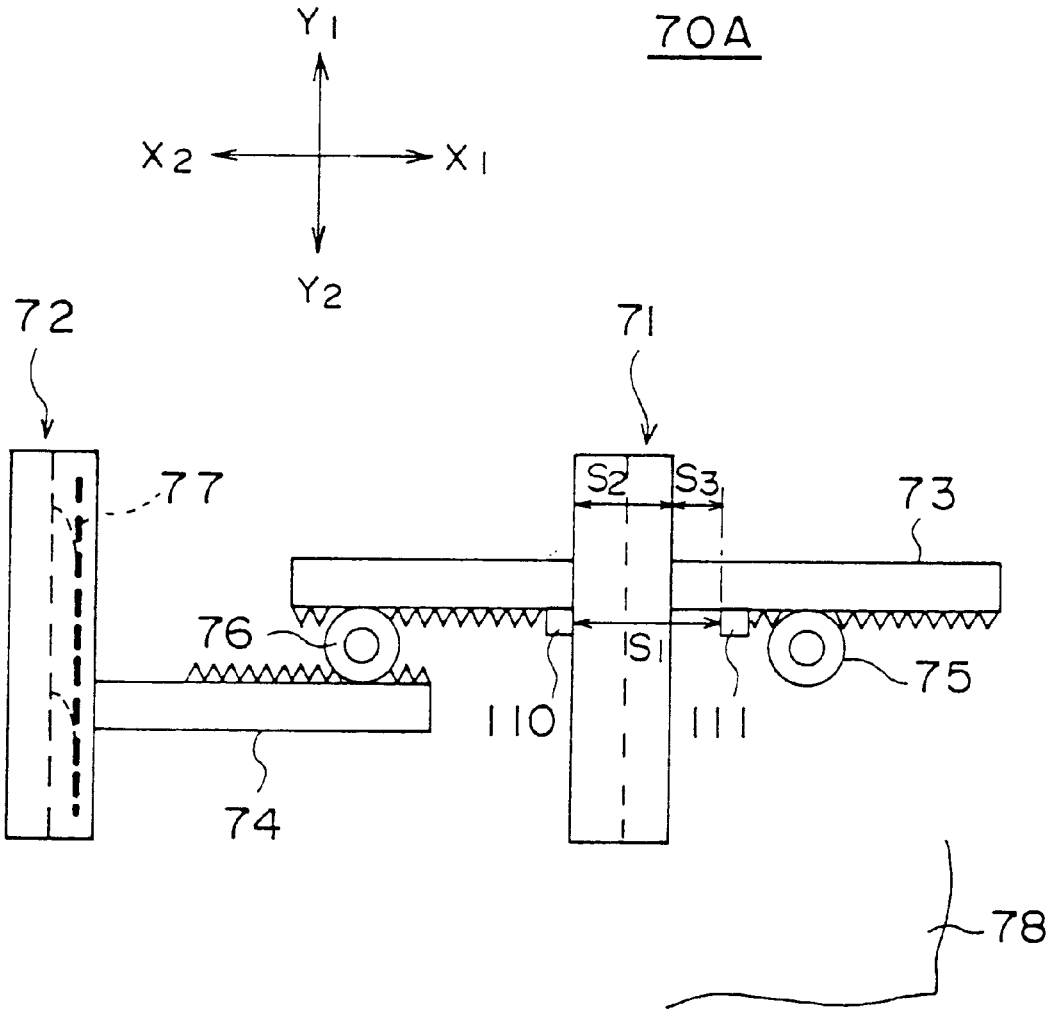
FIG. 11 is a diagram showing a top view of a paper position correcting device according to a first modified embodiment of the present invention.

Next, a first modified embodiment of the paper position correcting device (the width control device) 70 according to the present invention will be described with reference to FIGS. 11 and 12. FIG. 11 is a diagram showing a top view of the paper position correcting device 70A and FIGS. 12A through 12F are diagrams for explaining the operation of the paper position correcting device 70A.

The paper position correcting device 70A shown in FIG. 11 has substantially the same structure as the paper position correcting device 70 shown in FIG. 6 except for the below-mentioned differences. In FIG. 11, elements which are the same as the ones in FIG. 6 are indicated by the same reference numerals and the explanation thereof will be omitted for simplicity.

The paper position correcting device 70A may be characterized by a mechanism by which a shifting in position of a paper may not be caused after the position of the paper is once corrected after the first run so that the correction of the position of the paper in the width direction may be performed more accurately.

As shown in FIG. 11, the first guiding member 71 is provided so as to be movable, rather tightly, in the X1–X2 direction along a guide (not shown), on the bottom plate 78 of the both-side printing unit 22. The second guiding member 72 is fixed on the second rack 74.

Pins 110 and 111 are provided with the first rack 73 and the first guiding member 71 is located between the pins 110 and 111. When the first rack 73 is moved in the X2 direction, the pin 111 pushes the first guiding member 71 and the first guiding member 71 is moved in the X2 direction. When the first rack 73 is moved in the X1 direction, the pin 110 pushes the first guiding member 71 and the first guiding member 71 is moved in the X1 direction.

The interval, S1, between the pins 110 and 111 is determined to satisfy the equation, S1=S2+S3, where S2 is the width of the first guiding member 71. Thus, when the direction of the first rack 73 is changed, the backlash of the length S3 is generated between the first rack 73 and the first guiding member 71. Accordingly, the pins 110 and 111 provided with the interval, S1, form the backlash mechanism.

Figure 12A:
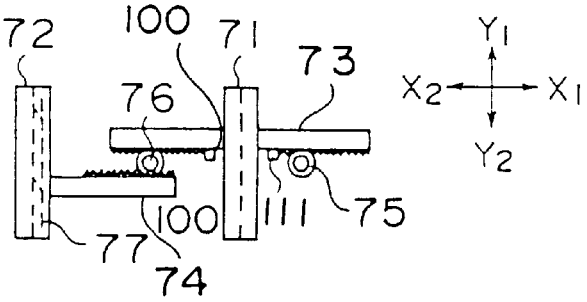
FIG. 12A is a diagram for explaining the operation of the paper position correcting device according to the first modified embodiment of the present invention.
Figure 12B:
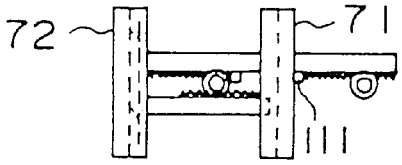
FIG. 12B is a diagram for explaining the operation of the paper position correcting device according to the first modified embodiment of the present invention.
Figure 12C:
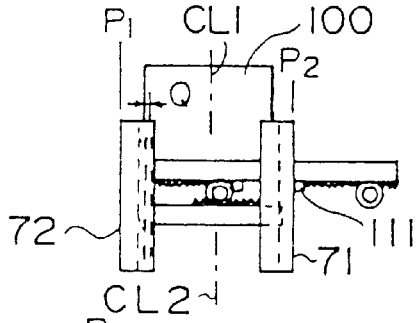
FIG. 12C is a diagram for explaining the operation of the paper position correcting device according to the first modified embodiment of the present invention.

The backlash, S3, is determined to be sufficiently larger than a flexure length, Q, in the X1–X2 direction of the leaf spring member 77 provided with the second guiding member 72 when the paper 100 contacts the leaf spring member 77 (refer to FIG. 12C).

Next, the operation of the paper position correcting device 70A will be explained with reference to FIGS. 12A through 12F. The initial state of the paper position correcting device 70A is shown in FIG. 11.

When the stepping motor 75 is rotated in the normal direction, the first rack 73 is moved in the X2 direction, and hence the second rack 74 is moved in the X1 direction via the connecting gear 76 as shown in FIG. 12A. The second guiding member 72 is moved in the X1 direction together with the second rack 74.

The first guiding member 71 is moved in the X2 direction pushed by the pin 111 after the first rack 73 is moved by the length corresponding to S3 in the X2 direction as shown in FIG. 12B.

Each of the first guiding member 71 and the second guiding member 72 moves to the position indicated by P2 and P1, respectively, at the end as shown in FIG. 12C. In this state, the position in the width direction of the paper 100 may be corrected between the first guiding member 71 and the leaf spring member 77 having the flexure size of Q, and the center line, CL1, of the paper 100 may be aligned with the center line, CL2, of the inverted paper path 58 (not shown).

Figure 12D:
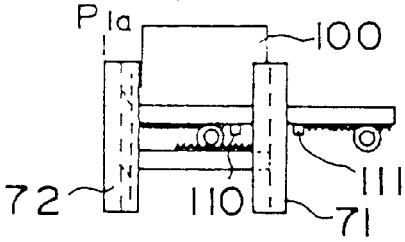
FIG. 12D is a diagram for explaining the operation of the paper position correcting device according to the first modified embodiment of the present invention.

When the rotation of the stepping motor 75 is reversed after the correction in position of the paper 100, the first rack 73 immediately starts moving in the X1 direction, and hence the second rack 74 is moved in the X2 direction via the connecting gear 76 as shown in FIG. 12D. Since there is no backlash provided with the second guiding member 72, the movement of the second guiding member 72 is synchronized with the movement of the second rack 74 from the beginning.

Figure 12E:
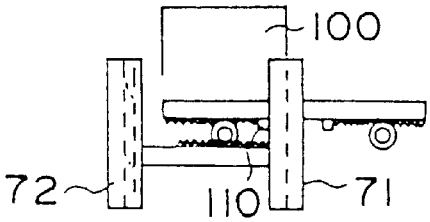
FIG. 12E is a diagram for explaining the operation of the paper position correcting device according to the first modified embodiment of the present invention.

As for the movement of the first guiding member 71, it is not moved at the beginning and stays at the position, P2, until the first rack 73 moves in the X1 direction for a length corresponding to the backlash length S3 and the pin 110 starts pushing the first guiding member 71 as shown in FIG. 12E. Here, since the first guiding member 71 contacts with a base other than the first rack 73 with a friction set to be larger than the biasing force of the elastic member 77, the movement of the first guiding member in the backlash is stable and it does not vibrate.

Figure 12F:
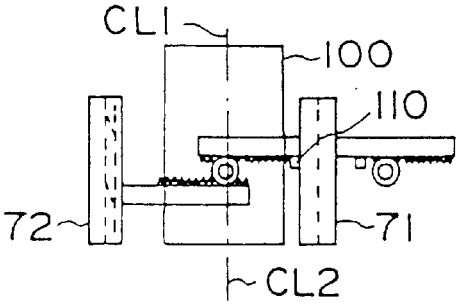
FIG. 12F is a diagram for explaining the operation of the paper position correcting device according to the first modified embodiment of the present invention.
Figure 13A:
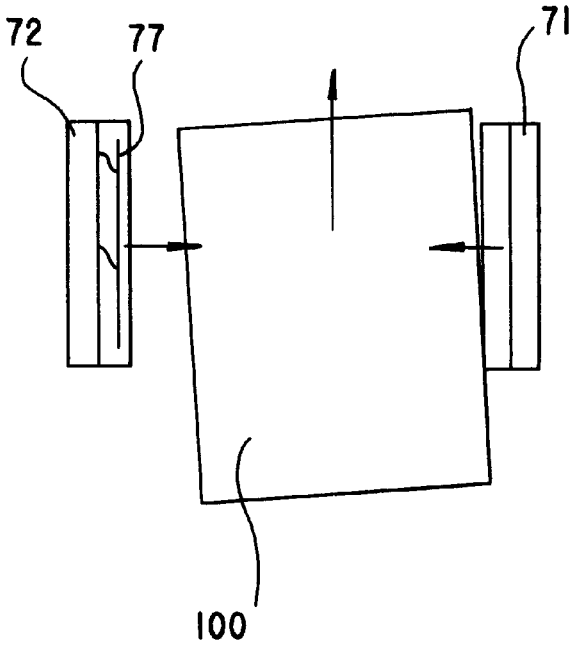
FIG. 13A is a diagram showing the relationship between first and second guiding members and a paper during a paper position correction operation according to the present invention.
Figure 13C:
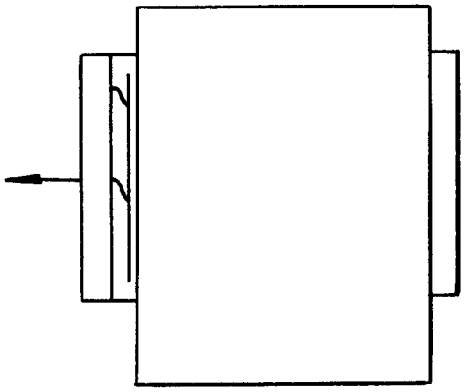
FIG. 13C is a diagram showing the relationship between first and second guiding members and a paper during a paper position correction operation according to the present invention.
Figure 13B:
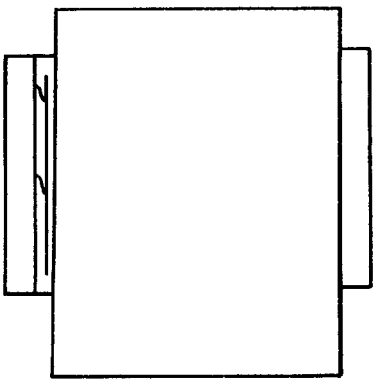
FIG. 13B is a diagram showing the relationship between first and second guiding members and a paper during a paper position correction operation according to the present invention.
Figure 13D:
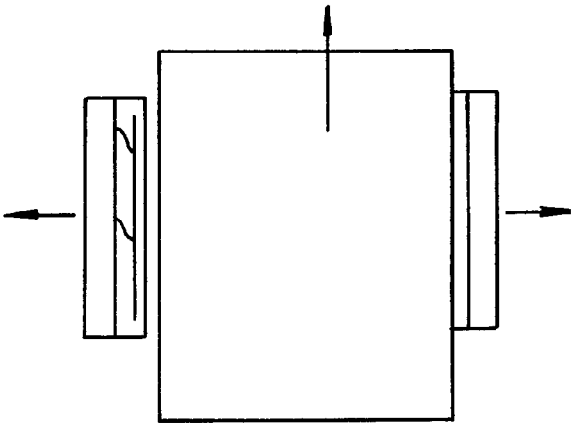
FIG. 13D is a diagram showing the relationship between first and second guiding members and a paper during a paper position correction operation according to the present invention.

In the end, the first and the second guiding members 71 and 72 and the first and the second racks 73 and 74 of the paper position correcting device 70A, respectively, return to their original positions as shown in FIG. 12F.

Also, FIGS. 12C through 12D show the state of the second guiding member 72 when it is moved in the X2 direction from the position P1 by the length corresponding to the flexure length Q and reaches a position P1a. At this stage, the leaf spring member 77, which has contacted the paper 100 to push it towards the X1 direction, is returned to the original position. That is, as the second guiding member 72 is moved in the X2 direction, the leaf spring member 77 starts gradually separating from the paper 100 and finally one side of the paper 100, which has been pushed by the leaf spring member 77 in the X1 direction becomes free and the other side of the paper contacts the first guiding member 71 which stays at the P2 position. This is possible since the movement of the first guiding member is not synchronized with the movement of the second guiding member 72 at the beginning due to the presence of the backlash, S3, as explained above. In this manner, the correct position of the paper 100 may be maintained. FIG. 12D shows the state of the second guiding member 72 in which the leaf spring member 77 contained in it is just separated from the paper 100. Then, as mentioned above, the first guiding member 71 is gradually moved in the X1 direction and starts separating from the paper 100. In this manner, the correction of the position of the paper 100 may be carried out smoothly according to the present invention.

The relationship between the first and the second guiding members 71 and 72 and the paper 100 is shown in more detail in FIGS. 13A through 13D. FIGS. 13A, 13B, 13C and 13D correspond to FIG. 12C, 12D, 12E and 12F, respectively. The movement of each of the first and the second guiding members 71 and 72 is indicated by the arrows. As clearly shown in the FIGS. 13C and 13D, the first guiding member 71 starts moving away from the paper 100 after the second guiding member 72 and the leaf spring member 77 are completely separated from the paper 100. Thus, when both of the first and the second guiding members 71 and 72 are separated from the paper 100, the position of the paper 100 is not shifted and the paper 100 may be stably entered into a second turn.

Figure 14:
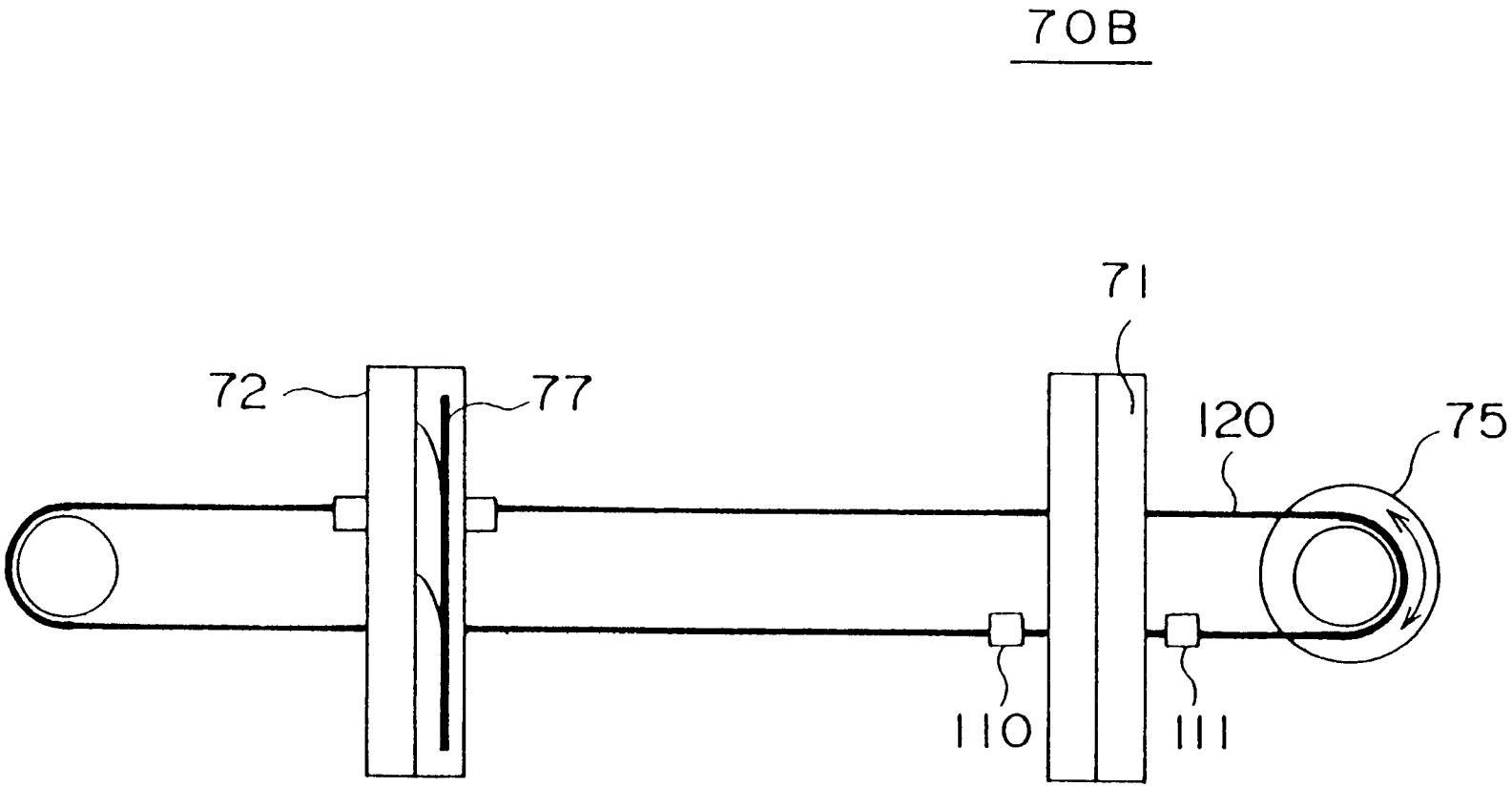
FIG. 14 is a diagram showing a second modified embodiment of the paper position correcting device according to the present invention.

FIG. 14 is a diagram showing a second modified embodiment of the paper position correcting device in a width direction (the width control device) according to the present invention. In FIG. 14, elements which are the same as the ones in FIG. 11 are indicated by the same reference numerals and the explanation thereof will be omitted.

A paper position correcting device 70B shown in FIG. 14 has a structure in which the first guiding member 71 and the second guiding member 72 are moved by a belt 120 instead of a rack-pinion mechanism used in the paper position correcting device 70 and 70A.

Figure 15:
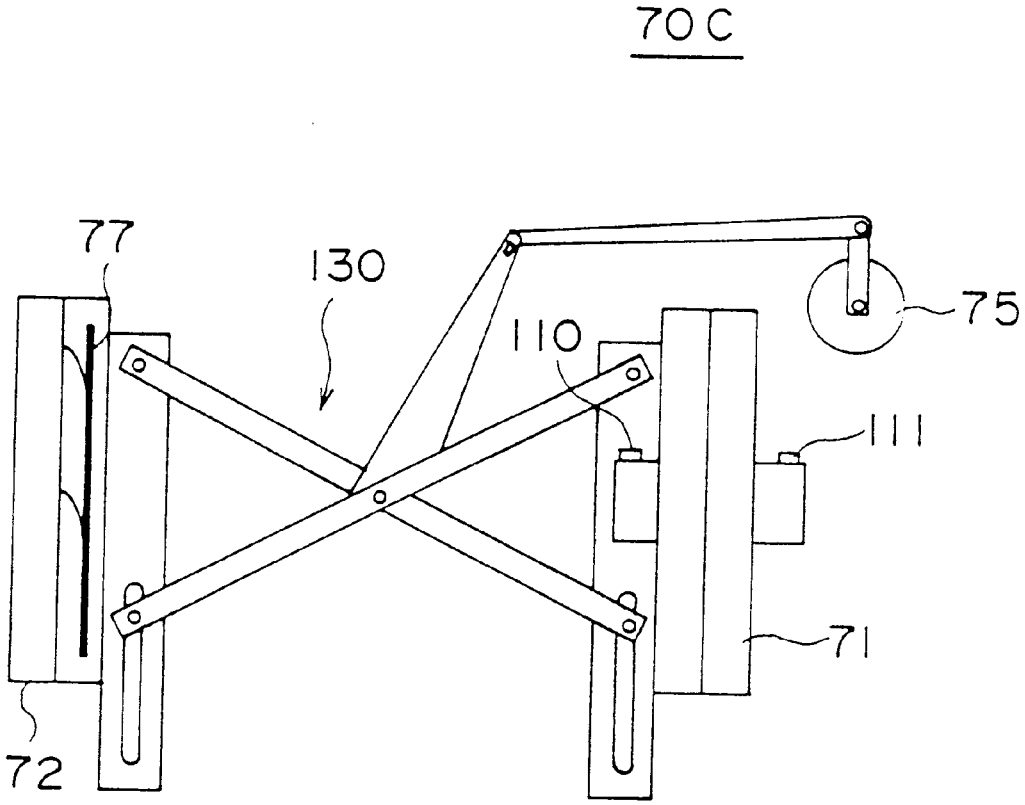
FIG. 15 is a diagram showing a third modified embodiment of the paper position correcting device according to the present invention.

Also, FIG. 15 is diagram showing a third modified embodiment of the paper position correcting device in a width direction (the width control device) according to the present invention.

A paper position correcting device 70C shown in FIG. 15 has a structure in which the first guiding member 71 and the second guiding member 72 are moved by a link mechanism 130 instead of the rack-pinion mechanism used in the paper position correcting device 70 and 70A.

Although the present invention has been explained with certain embodiments in which the printer body 21 and the both-side printing unit 22 may be separated, it is possible, of course, to integrally form the printer body and the both-side printing unit from the beginning.

Moreover, the present invention is not limited to the above-explained embodiments, and variations and modifications may be made without departing from the scope of the present invention.

What is claimed is:

1. An image forming device comprising:

an image forming part which forms an image on a recording medium;

a recording medium switchback portion which receives said recording medium on a first run, one side of which has been printed when passing said image forming part, and sends said recording medium for a second run;

an inverted recording medium transfer path through which said recording medium is sent to said image forming part with an upper surface and a lower surface of said recording medium reversed;

a recording medium transfer part which transfers said recording medium along said inverted recording medium transfer path;

a recording medium position correcting part, located at said inverted recording medium transfer path, which corrects a position in a width direction of said recording medium, and a control means for controlling said recording medium position correcting part with a particular operation timing so that said recording medium position correcting part is operated while said recording medium is transferred without interruption along said inverted recording medium transfer path by said recording medium transfer part.

2. The image forming device as claimed in claim 1, wherein said recording medium transfer part is provided just in front of said recording medium position correcting part with respect to a recording medium transfer direction.

3. The image forming device as claimed in claim 1, wherein said recording medium transfer part is comprised of a single transfer roller which rotates in the recording medium transfer direction and a single pinch roller which is provided so as to push said transfer roller.

4. The image forming device as claimed in claim 3, wherein said pinch roller pushes said transfer roller with a relatively weak force so that a position of said recording medium may be corrected while said recording medium is pinched by said recording medium transfer part.

5. The image forming device as claimed in claim 3, wherein said transfer roller has a convex outer surface.

6. The image forming device as claimed in claim 1, further provided with at least one stacker which stores said recording medium one on another.

7. The image forming device as claimed in claim 1, wherein said recording medium position correcting part is comprised of:

a first guiding member which guides one side of said recording medium;

a second guiding member which guides the other side of said recording medium;

an elastic member, provided with one of said first guiding member and said second guiding member, which is deformed upon contact with said recording medium so that a position of said recording medium may be corrected between said first guiding member and said second guiding member;

an operation mechanism by which said first guiding member and said second guiding member may be moved relative to each other in one of a direction to expand the distance between them and a direction to reduce the distance between them; and a backlash mechanism, provided for one of said first guiding member and said second guiding member which is not provided with said elastic member, which generates backlash in movement of said one of said first guiding member and said second guiding member which is not provided with said elastic member, wherein movement of one of said first guiding member and said second guiding member which is provided with said backlash mechanism is set to be delayed from movement of the other guiding member due to the presence of backlash when said first guiding member and said second guiding member are returned to their respective initial positions after the position of said recording medium is corrected.

8. The image forming device as claimed in claim 7, wherein said one of said first guiding member and said second guiding member which is not provided with said elastic member starts moving away from said recording medium, after the position of said recording medium is corrected, after said one of said first guiding member and said second guiding member which is provided with said elastic member is completely separated from said recording medium.

* * * * *